US006617293B2

(12) United States Patent
Chen

(10) Patent No.: US 6,617,293 B2
(45) Date of Patent: Sep. 9, 2003

(54) THICKENING ON DILUTION LIQUID SOAP

(75) Inventor: Yen-Lane Chen, New Brighton, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/922,664

(22) Filed: Aug. 6, 2001

(65) Prior Publication Data

US 2003/0050200 A1 Mar. 13, 2003

(51) Int. Cl.[7] ..... C11D 1/75; C11D 1/02; C11D 1/83; C11D 3/30

(52) U.S. Cl. ..... 510/125; 510/127; 510/130; 510/137; 510/138; 510/158; 510/159; 510/503; 510/506; 510/509

(58) Field of Search ..... 510/122, 123, 510/124, 125, 127, 130, 137, 138, 158, 159, 503, 506, 509

(56) References Cited

U.S. PATENT DOCUMENTS

| | | | | | |
|---|---|---|---|---|---|
| 4,155,871 | A | | 5/1979 | Donaldson | 252/156 |
| 4,880,569 | A | | 11/1989 | Leng et al. | 252/550 |
| 5,207,951 | A | | 5/1993 | Saver et al. | 252/547 |
| 5,425,404 | A | | 6/1995 | Dyer | 141/351 |
| 5,573,710 | A | | 11/1996 | McDonell | 510/405 |
| 5,767,051 | A | * | 6/1998 | Drapier et al. | 510/235 |
| 5,767,055 | A | | 6/1998 | Choy et al. | 510/406 |
| 5,797,986 | A | * | 8/1998 | Rolando et al. | 134/6 |
| 5,817,615 | A | | 10/1998 | Garabedian, Jr. et al. | 510/503 |
| 5,833,999 | A | * | 11/1998 | Trinh et al. | 424/401 |
| 5,837,661 | A | * | 11/1998 | Evans et al. | 510/122 |
| 5,929,024 | A | * | 7/1999 | Stringer et al. | 510/504 |
| 6,150,320 | A | | 11/2000 | McDonell | 510/407 |
| 6,156,712 | A | * | 12/2000 | Stringer et al. | 510/125 |

FOREIGN PATENT DOCUMENTS

| | | |
|---|---|---|
| EP | 0244611 | 11/1987 |
| EP | 0314232 | 5/1989 |
| EP | 0359308 | 3/1990 |
| EP | 0518401 | 12/1992 |
| EP | 0253676 | 8/1994 |
| EP | 0724013 | 7/1996 |
| GB | 2260771 | 4/1993 |
| WO | WO93/00006 | 1/1993 |
| WO | WO93/21900 | 11/1993 |
| WO | WO95/02664 | 1/1995 |
| WO | WO95/33810 | 12/1995 |
| WO | WO96/03483 | 2/1996 |
| WO | WO96/21721 | 7/1996 |
| WO | WO97/05220 | 2/1997 |

* cited by examiner

*Primary Examiner*—Gregory Delcotto
(74) *Attorney, Agent, or Firm*—Carolyn V. Peters

(57) ABSTRACT

A concentrated liquid soap composition that readily increases in viscosity upon dilution with water, the concentrated liquid soap composition containing an amine oxide surfactant or mixture thereof having the general formula R1R2 R3N→O, where R1 and R2 are the same or different and are selected from methyl or ethyl and R3 is a straight chain saturated or unsaturated alkyl group having from about 6–24 carbon atoms; an anionic surfactant or mixture thereof; an electrolyte; water; and a buffering agent, sufficient to maintain the pH of the composition between about 8 and about 10.

17 Claims, No Drawings

THICKENING ON DILUTION LIQUID SOAP

FIELD OF THE INVENTION

The present invention relates to a liquid soap and particularly to a liquid soap specifically formulated to thicken upon dilution.

BACKGROUND OF INVENTION

There has been a trend in the commercial care cleaning and personal care industries to supply concentrated products that can be diluted with water either manually or by a dispenser to provide "ready-to-use" (RTU) products for the end user. This approach reduces the costs associated with the bulk packaging, handling, transportation, and storage of such products.

Liquid soap manufacturers can purchase concentrated surfactant blends and typically these concentrate blends are very viscous liquids or semi-solids. These concentrated surfactant blends are commonly a blend of anionic surfactants, amphoteric surfactants, and alkanolamide type surfactants. Appropriate amounts of water, fragrance, and dye are later added to these surfactant blends in the soap manufacturing plant to make a finished product.

Typically, upon dilution with water, the concentrated liquid soap become thinner, that is, a soap with reduced viscosities. This results in a RTU liquid soap having a viscosity that is generally equal to or less than the viscosity of the concentrate surfactant blend. Thus, the concentrate surfactant blends offer little benefit or convenience to the soap manufacturer or end-users due to the low dilution ratio (about 2:1 or 3:1 water:concentrate).

Unfortunately, higher dilution ratios result in low viscosity solutions that are undesirable for liquid hand soap, shampoo, or body wash type product applications. It is often necessary to add thickening agents when diluting the concentrate to increase the viscosity of the RTU soap.

European patent application (EP 0724013 A1) discloses a detergent concentrate of two or more surfactants having differing resistance to electrolytic salting out in the form of micellar solutions, thus, lower viscosity in the concentrate state. Upon dilution with water, the micellar phase transforms into a lamellar phase that leads to an increase in viscosity. However, the concentrate described in this application still has rather higher viscosity (about 2500 cps), and the diluted concentrate has a viscosity equal or less than that of the undiluted concentrates (200 to 2500 cps). Generally for RTU liquid hand soaps, the desired viscosity should range from about 1000 to about 15000 cps.

As disclosed in WO95102664, a liquid concentrate is described, which when diluted with water to gives a liquid composition, having the same viscosity or increase in viscosity. The concentrate contains a thickening component described as (1) a surfactant consisting of an ether sulfate or a mixture with another anionic surfactant or nonionic or amphoteric, or a cationic surfactant, and an electrolyte. The levels of electrolyte disclosed in the examples are all exceedingly high (13–17%). The dilution ratio is typically 3:1 or 4:1. However, the reference failed to recognize the instability of diluted liquid caused by pH drift, ultimately influencing the viscosity of the final product.

It is known that nonionic surfactants such as amine oxides will spontaneously form rod-like micelles upon the addition of solvent (e.g. water), thereby forming a thickened solution, and this thickening-on-dilution property does not require the presence of electrolytes. In U.S. Pat. No. 6,150,320, a concentrated hand soap composition is disclosed that gives the same or higher viscosity when diluted with water. Unfortunately, the viscosity of the diluted liquid soaps was not very high.

There has been a commercial liquid soap that utilizing the synergistic thickening mechanisms of amine oxide and anionic surfactants-electrolytes interactions to achieve thickening-on-dilution property. However, the thickened solution is sensitive to the pH of the solution.

Certain anionic surfactants such as alkyl alcohol sulfates or alkyl ether sulfates are known to be unstable in acidic condition, thus it is common practice to add pH adjusters such as citric acid or NaOH to shift the pH of the liquid soap to about 7. However, those pH adjusters do not have the capacity to maintain constant pH, so when the pH of the soap solution drift to a lower pH (acid) over time, the surfactants will be hydrolyzed and soap performance is lost.

There exists a need for low viscosity concentrate surfactant blends such that the soap concentrate can be diluted with water, preferably using a gravity feed type fluid dispensing system, where the diluted RTU soap has a significantly higher viscosity without exhibiting significant phase separation or crystallization, and is pH stable.

SUMMARY OF INVENTION

Briefly, in one aspect of the present invention, a liquid soap composition is provided comprising:

(a) about 5% to 20% by weight of an amine oxide surfactant or mixture thereof having the general formula R1R2 R3N→O, where R1 and R2 are the same or different and are selected from methyl or ethyl and R3 is a straight or branched chain saturated or unsaturated alkyl group having from about 6–24 carbon atoms;

(b) about 10% to 40% by weight of an anionic surfactant or mixture thereof;

(c) about 2% to 5% by weight of an electrolyte;

(d) a water content of about 10% to 40% by weight; and (e) about 0.5% to 5% by weight of a buffering agent, sufficient to maintain the pH of the composition between about 8 and about 10.

concentrated liquid soap composition which readily increases in viscosity upon dilution with water, the concentrated liquid soap composition comprising Advantageously, the formulations of the present invention thicken upon dilution and are pH stable. In the present invention, the pH of the diluted soaps is maintained between 8 and 10. While not intending to be bound by theory, it is believed that this pH range facilitates the formation of microstructure of the surfactants, which in turn "thickens" the RTU soap. Generally, a pH drift below 8 will turn amine oxides into a cationic surfactant which is incompatible with the anionic surfactants in the composition. A tradition pH adjuster is not sufficient to maintain long-term stability of the RTU liquid soaps.

Advantageously, the buffer system used in the present invention will not disrupt or interfere the formation of the microstructure of the soap surfactant in the diluted state and provides the improved RTU soap stability.

DESCRIPTION OF THE PREFERRED EMBODIMENT(S)

This invention describes a low viscosity concentrate surfactant system that readily increases in viscosity upon dilution with water to give a ready-to-use liquid soap that is pH stable over time. The concentrate comprises an amine oxide surfactant, an anionic surfactant, an electrolyte, and a buffering agent.

The viscosity of the concentrate is sufficiently low (less than about 300 cps) so it is easily pumpable or easily gravity feedable so that it can be dispensed by a variety of dispensing systems, including gravity feed type dispensing systems such as the 3M Twist 'n Fill™ dispenser. The dilution ratio of water to concentrate (weight of water to weight of concentrate) for the soap applications ranges from 5:1 to 15:1. This produces ready-to-use soaps with a viscosity range of from about 500 to 15,000 cps.

Particularly useful classes of anionic surfactants in the present invention include sodium lauryl sulfates, ammonium lauryl sulfates, and lauryl ether sulfates having various degree of ethoxylation to build the viscosity. Examples of these classes of anionic surfactants include those sold under the tradename "EMPICOL", available from Rhodia, Cranbury, N.J. Preferably, the total amount of anionic surfactant (the active ingredient) in the concentrate is about 10% by weight and not greater than approximately 40% by weight of the total composition, more preferably from about 10% to 25% by weight.

The electrolyte used in the compositions of the present invention will typically be sodium chloride. However, other water soluble electrolytes, such as ammonium chloride, may also be used. Preferably, the total amount of electrolyte (the active ingredient) in the concentrate is about 2% by weight and not greater than approximately 15% by weight of the total composition, more preferably from about 2% to 10% by weight of the total composition.

The amount of anionic surfactants and electrolyte that can be incorporated in the concentrate for building viscosity in the ready-to-use soap is limited by their solubility in water. To provide additional viscosity, amine oxide surfactants are added in the system. Amine oxide surfactants useful in the present invention for use in combination with the anionic surfactant include compounds having the general formula (I)

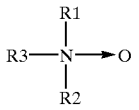

(I)

wherein R1 and R2 are the same or different and are selected from the group consisting of alkyl and substituted alkyl groups, such as methyl, ethyl, propyl, isopropyl, hydroxyethyl, hydroxypropyl, and the like. R3 is selected from the group consisting of saturated or unsaturated straight chain alkyls, branched chain alkyls, straight chain heteroalkyls, and branched chain heteroalkyls, each having from about 6 to 24 carbon atoms, and may include alkyl ethers having from 6 to 24 carbons. Preferably, R1 and R2 are methyl or ethyl and R3 is a straight chain saturated or unsaturated alkyl group having from about 6–24 carbon atoms.

Amine oxides useful in the compositions of the present invention include amine oxides such as the amine oxide/polyethylene glycol mixture known under the trade designation "ADMOX LA-1440", available from Albemarle Chemical Co., Baton Rouge, La., in which the amine oxide of the mixture is characterized by R1 and R2 each being methyl, while R3 is myristyl, this amine oxide also known as N,N-dimethyl-1-tetradecamine oxide dihydrate. The polyethylene glycol (PEG) portion of the mixture has a molecular weight of about 200, having 4 ethylene oxide units, although the molecular weight may range anywhere from 100 to 300. These amine oxide/PEG mixtures are high foaming, making their use especially attractive in liquid hand soap applications. Preferably, the total amount of amine oxide in the compositions according to the present invention is from 5% to 20% by weight of the total composition.

Amine oxides are readily soluble in water and other polar solvents and exhibit amphoteric character, which is mostly likely due to the polar NO head group. In acidic solutions, the negatively charged oxygen is protonated and a cationic ammonium species is formed. In alkaline solutions, amine oxides behave like non-ionic surfactants solubilized via hydrogen bonding. This pH-dependent character of amine oxides influences their compatibility with anionic surfactants. At low pH, an area of non-compatibility exists that results in precipitation. At high pH, amine oxides are completely compatible with anionic surfactants. However, the pH range for compatibility with anionic surfactants depends significantly on the type of surfactants and the mixing ratio of anionic surfactants and amine oxides.

In the present invention, the viscosity induced through the anionic surfactant-electrolyte interaction is not affected by the pH of the solution. However, the viscosity of the amine oxide increases with increasing alkalinity, reaches a maximum, and then decreases again with a further increase in pH.

The pH of the solution of the present invention needs to be maintained above about 8 to prevent the amine oxide from becoming cationic. Preferably, the pH of the diluted soap needs to be maintained above 8, more preferably between 8 and 10. When the pH of the solution is above 8, the amine oxide is nonionic in nature and is compatible with the anionic surfactants in the soap solution. However, the pH of the ready-to-use soap tends to slowly drift below 8 over time. When the pH drifts below 8, the amine oxide becomes cationic and is incompatible with the anionic surfactants in the composition. This results in a decrease in the viscosity of the ready-to-use liquid soap, which is undesirable. Traditional pH adjusters were found to be insufficient to maintain the long-term stability of the ready-to-use liquid soaps. A buffering agent that will not disrupt or interfere with the formation of the microstructure of the soap surfactants in the diluted state is necessary for maintaining the pH of the ready-to-use liquid soap.

Buffering agents that are useful in the present invention include sodium carbonate, sodium bicarbonate, sodium borate, monoethanolamine, ammonium carbonate, and ammonium carbamate. It has also been found that the buffering capacity is greatly enhanced by adding a co-buffer such as an alkaline hydroxide, in particular sodium or ammonium hydroxide. The most preferable buffer system is 1:1 ratio of sodium tetraborate (10) hydrate:sodium hydroxide at a level of 0.1% to 5% by weight, most preferably from 0.5% to 1% by weight in the concentrate, and when diluted by water, the level of sodium borate and sodium hydroxide is about 0.1% to 0.2% by weight. This buffer system brings the pH of the ready-to-use soap to above 8 and also provides excellent buffer capacity, rendering the ready-to-use soap more resistant to contamination and improving the shelf life.

Other surfactants such as alkanonamides, betaine, sultaine, pearlizer, glycerin can be added to the system to enhance the lather and feel of the soaps. Additionaly surfactants can include nonionic surfactant such as those selected from the group consisting of polyalkoxylated fatty acids and their esters, alkanolamides, glucosides, ethoxylated alkanolamides, ethoxylated long chain amines, alkyl amines, fatty esters, alkyl polyglycosides. Amphoteric co-surfactant ca be selected from the group consisting of alkyl betains, alkyl sulfobetains, alkyl aminopropionates, alkyl iminopropionates, alkyl glycinates, carboxyglycinates, alkyl imidazolines sulfobetains, alkyl polyaminocarboxylates, polyamphocarboxyglycinates. Additional surfactants may include nonionic or amphoteric surfactants or a combination of both surfactants. If used, the additional surfactants typically should not exceed 30% by weight.

Depending on the type and amounts total surfactants in the concentrate system, the viscosity may become too high that it is not suitable to be dispensed through certain types of dispensing systems, such as a gravity feed type fluid dispenser. In this invention, a solvent may optionally be added to the concentrate for reducing the viscosity of the concentrate so that a proper flow rate may be attained. The type and amount of solvent used need only be effective in disrupting the microstructure in the concentrate state and has minimal or no effect on the microstructure of the diluted concentrate. In addition, the added solvent should not adversely effect on other properties of the ready-to-use soaps. For example, the solvent should not reduce the foam or lather of the soap, leave greasy or slippery feeling on the skin after the hand washing, or cause any skin irritation. Short chain alcohols such as methanol or ethanol, glycol ether or acetates such as propylene glycol methyl ether (PM Ether), dipropylene glycol methyl ether acetate, diethylene glycol methyl ether, ethylene glycol n-butyl ether, diethylene glycol n-butyl ether, and the like and combinations thereof are useful in the present invention. The more preferred.

Preferably, the total amount of solvent in the composition according to the present invention is not greater than 20% by weight of the total composition. A particularly preferred solvent is PM ether.

The compositions of the present invention may include various optional additives such as a colorant to provide a more aesthetic appearance, a fragrance to provide more acceptable smell, a preservative to prevent microbial growth in the solution, a suitable agent to eradicate germs, mold or mildew, antioxidants, within general formula I and chelating agents that may be required with certain other surfactants, pH adjustment chemicals, and the like. Such components are well known in the art and specific amounts of each will be within the knowledge of the skilled artisan.

The compositions of the invention can, of course, be made, sold, and used as concentrates, or in diluted form. When in diluted or ready-to-use form, the compositions preferably have the same ratios of active ingredients as the concentrates. Compositions of the present invention are particularly useful for personal care products such as hand soaps, body washes, and shampoos where high viscosity is desirable. The water dilutable concentrates will reduce the bulk of packaging and lower the transportation and handling costs associated with distribution. The concentrate soap can be packaged in small bag and diluted manually into a container or it can be filled in a bottle and be diluted to proper ratio by using a variety of dispensing systems.

The objects, features and advantages of the present invention are further illustrated by the following examples, but the particular materials and amounts thereof recited in these examples, as well as other conditions and details, should not be construed to unduly limit this invention. All materials are commercially available or known to those skilled in the art unless otherwise stated or apparent. All parts and percentages in the Examples and the Specification are by weight, unless otherwise specified.

Test Methods

Viscosity

Viscosity measurements were obtained with a Brookfield Viscometer Model LVTD using a #4 spindle at 12 rpm. The values presented in the Tables are an average of about three measurements.

Glossary

"ADMOX LA1440" is 40% N,N-dimethyl tetradecamine oxide dihydrate in polyethylene glycol (PEG), available from Albermarle, Baton Rouge, La.

"ALKAMIDE LE" is cocamide diethanloamine, available from Rhodia, Cranbury, N.J.

"BELLE AIRE #21813" is a fragrance, available from Belle Aire, Mundelein, Ill.

"EMPICOL 0303/VA" is (98% active ingredient) sodium lauryl sulfate, available from Rhodia, Cranbury, N.J.

"EMPICOL AL 70/A2" is (70% active ingredient) ammonium lauryl sulfate, available from Rhodia, Cranbury, N.J.

"EMPICOL ESA/A2" is (25% active ingredient) sodium lauryl ether sulfate (1 mole of ethylene oxide), available from Rhodia, Cranbury, N.J.

"EMPICOL ESB/70" is (70% active ingredient) sodium lauryl ether sulfate (2 moles of ethylene oxide), available from Rhodia, Cranbury, N.J.

"EMPIGEN BB/FLA" is (35% active ingredient) lauramidopropyl betaine, available from Rhodia, Cranbury, N.J.

"EMPIGEN BS/A2" is (40% active ingredient) lauramidomethyl betaine, available from Rhodia, Cranbury, N.J.

"EMPILAN CDE/A6" cocamide diethylamine, available from Rhodia, Cranbury, N.J.

"GLYDANT PLUS" is a preservative, available from Lonza, Fairlawn, N.J.

"PM ETHER" is propylene glycol methyl ether, available from Eastman Chemical Company, Kingsport, Tenn.

"QUICK PEARL I" is a glycol stearate (35% active ingredient), available from Chemron, Bowling Green, Ohio.

"RED #33" is a dye, available from Pylam, Tempe, Ariz.

Sodium borate (10 hydrate) is available from Mallinckrodt Baker, Inc., Phillipsburg, N.J.

"SZ 8205" is a fragrance, available from J. E. Sizio, Edison, N.J.

"LX 9572 TURQUOISE BLUE" is a dye, available from Pylam, Tempe, Ariz.

EXAMPLES

Comparative Examples C1–C2 and Example 1

Three soap concentrates were prepared from which ready-to-use compositions were subsequently prepared. The compositions of the soap concentrates for Comparative Examples C1–C2 and Example 1 are presented in Table 1. The following preparation procedure was typical. Components 1, 2, and 3 were added into a glass jar equipped with a magnetic stirrer and the materials were stirred at room temperature until the solids were completely dissolved. Components 4 and 5 were then added with stirring. The remaining components were then added one at a time with stirring until complete dissolution was obtained. Example C1 is commercially available under the tradename of "$_{13}$".

TABLE 1

| Component | Material | Example C1 (%) | Example C2 (%) | Example 1 (%) |
|---|---|---|---|---|
| 1 | Deionized water | 36.437 | 36.287 | 35.387 |
| 2 | NaCl | 7.5 | 7.5 | 7.5 |
| 3 | GLYDANT Plus | 0.4 | 0.4 | 0.4 |
| 4 | EMPICOL 0303/VA | 8.0 | 8.0 | 8.0 |
| 5 | PM Ether | 8.0 | 8.0 | 8.0 |
| 6 | EMPIGEN BS/A2 | 10.0 | 10.0 | 10.0 |
| 7 | ADMOX LA 1440 | 11.0 | 11.0 | 11.0 |
| 8 | EMPICOL AL 70/A2 | 2.0 | 2.0 | 2.0 |
| 9 | EMPICOL ESB 70/A2 | 7.0 | 7.0 | 7.0 |
| 10 | EMPILAN CDE/A6 | 9.5 | 9.5 | 9.5 |
| 11 | BELLE AIRE #21813 | 0.16 | 0.16 | 0.16 |
| 12 | RED #33 | 0.003 | 0.003 | 0.003 |
| 13 | NaOH (50%) | — | 0.15 | 0.15 |
| 14 | Sodium borate (10 hydrate) | — | — | 0.9 |

The soap concentrates of Comparative Examples C1–C2and Example 1 were diluted 8:1 with deionized water to make ready-to-use versions of each. The effect of acid on the ready-to-use soap compositions was examined. A 200 gram sample of the ready-to-use soap solution was measured into a glass beaker. Two drops of citric acid was added to the soap solution and the mixture was stirred. Once the pH of the solution had stabilized, viscosity measurements were taken as described above. To this solution another two drops of citric acid was added and again once the pH of the solution had stabilized, viscosity measurements were taken. The procedure was repeated until the maximum amount of citric acid that was added to the soap solution was attained. Viscosity data are presented in Table 2.

TABLE 2

| Drops of Citric Acid | Example C1 (Viscosity) | Example C2 (Viscosity) | Example 1 (Viscosity) |
|---|---|---|---|
| 0 | 2350 | 2550 | 2750 |
| 2 | — | — | 2900 |
| 4 | — | — | 2500 |
| 6 | 800 | 2050 | 3200 |
| 8 | — | — | 3000 |
| 10 | — | — | 3200 |
| 12 | 250 | 500 | — |
| 14 | — | — | 2700 |
| 17 | — | — | 1900 |

The data indicates that the ready-to-use soap solution C1, without a pH adjuster was somewhat unstable, while the soap solution of C2, with a pH adjuster was more stable, although there is a risk that the pH will drift over time. In contrast, the soap solution (Example 1), with the added buffer system is more resistant to the addition of citric acid. The viscosity remained essentially constant, even when a significant amount of acid was added to the solution.

Examples 2 and 3

Two additional soap concentrates were prepared, similar to Example 1 above, from which ready-to-use compositions were subsequently prepared. The compositions of the soap concentrates for Examples 2 and 3 are presented in Table 3.

TABLE 3

| Component | Material | Example 2 (%) | Example 3 (%) |
|---|---|---|---|
| 1 | Deionized water | 24.887 | 29.385 |
| 2 | NaCl | 7.0 | 6.0 |
| 3 | GLYDANT Plus | 0.4 | 0.4 |
| 4 | EMPICOL 0303/VA | 8.5 | 8.5 |
| 5 | PM Ether | 8.0 | 10.0 |
| 6 | EPICOL ESB/70 | | 10.0 |
| 7 | EMPIGEN BB/FLA | 7.0 | 10.0 |
| 8 | ADMOX LA 1440 | 12.0 | 12.0 |
| 9 | EMPICOL ESA/A2 | 25.0 | — |
| 10 | QUICKPEARL I | — | 6.5 |
| 11 | ALAKAMIDE LE | 6.0 | 6.0 |
| 12 | BELLE AIRE #21813 | 0.16 | — |
| 13 | SZ 8205 | — | 0.16 |
| 14 | RED #33 | 0.003 | — |
| 15 | LX 9572 TURQUOISE BLUE | — | 0.005 |
| 16 | NaOH (50%) | 0.15 | 0.15 |
| 17 | Sodium borate (10 hydrate) | 0.9 | 0.9 |

The soap concentrates of Examples 3 and 4 were diluted from 3:1 to 11:1 with deionized water to make ready-to-use versions of each. The effect of dilution was examined by measuring the viscosity of each solution using the method described above. Viscosity data are presented in Table 4.

TABLE 4

| Dilution | Example 2 (Viscosity) | Example 3 (Viscosity) |
|---|---|---|
| 3:1 | 400 | 1450 |
| 4:1 | 800 | 4650 |
| 4.5:1 | 4500 | 7000 |
| 4.8:1 | — | 10100 |
| 5:1 | 7700 | 8850 |
| 5.5:1 | — | 7900 |
| 5.8:1 | — | 6900 |
| 6:1 | 5700 | 7000 |
| 6.5:1 | — | 3400 |
| 7:1 | 4900 | 2050 |
| 7.5:1 | 4300 | — |
| 8:1 | 4000 | 300 |
| 8.5:1 | 3900 | — |
| 9:1 | 2350 | 50 |
| 10:1 | 1000 | — |
| 11:1 | 100 | — |

Example 2 is illustrative of a soap composition that would be useful for economically priced liquid hand soaps where a viscosity of about 4000–5000 cps is typical for a higher dilution ratio (about 8:1). Example 3 would be particularly useful for higher priced liquid hand soaps where the dilution ratio is lower (about 5:1) and the viscosity is very high (about 7000–10000 cps).

Various modifications and alterations of this invention will become apparent to those skilled in the art without departing from the scope and principles of this invention, and it should be understood that this invention is not to be unduly limited to the illustrative embodiments set forth hereinabove. All publications and patents are incorporated herein by reference to the same extent as if each individual publication or patent was specifically and individually indicated to be incorporated by reference.

What is claimed:

1. A concentrated liquid soap composition which readily increases in viscosity upon dilution with water, the concentrated liquid soap composition comprising:

(a) about 5% to 20% by weight of an amine oxide surfactant or mixture thereof having the general formula R1R2 R3N→O, where R1 and R2 are the same or different and are selected from methyl or ethyl and R3 is a straight chain saturated or unsaturated alkyl group having from about 6–24 carbon atoms;

(b) about 10% to 40% by weight of an anionic surfactant or mixture thereof;

(c) about 2% to 5% by weight of an electrolyte;

(d) a water content of less than 50% by weight; and (e) about 0.5% to 5% by weight of a buffering agent, sufficient to maintain the pH of the composition between about 8 and about 10.

2. The composition according to claim 1 wherein the anionic surfactant is selected from the group consisting of sodium lauryl sulfates, ammonium lauryl sulfates, sodium lauryl ether sulfates, and ammonium lauryl ether sulfates.

3. The composition according to claim 2 further including a nonionic surfactant, an amphoteric surfactant, or a combination of both surfactants.

4. The composition according to claim 3 wherein the nonionic surfactant is selected from the group consisting of polyalkoxylated fatty acids and their esters, alkanolamides, glucosides, ethoxylated alkanolamides, ethoxylated long chain amines, alkyl amines, fatty esters, and alkyl polyglycosides.

5. The composition according to claim 3 wherein the amphoteric surfactant is selected from the group consisting of alkyl betains, alkyl sulfobetains, alkyl aminopropionates, alkyl iminopropionates, alkyl glycinates, carboxyglycinates, alkyl imidazolines sulfobetains, alkyl polyaminocarboxylates, polyamphocarboxyglycinates.

6. The composition according to claim 3 or 4 further comprising 20% or less of a viscosity reducing solvent.

7. The composition according to claim 6 wherein the viscosity reducing solvent is selected from the group consisting of short chain alcohols, glycol ethers, and glycol acetates.

8. The composition according to claim 7 wherein the viscosity reducing solvent is a glycol ether or a glycol acetate and is selected from the group consisting of propylene glycol methyl ether, dipropylene glycol methyl ether acetate diethylene glycol methyl ether, ethylene glycol n-butyl ether, and diethylene glycol n-butyl ether.

9. The composition according to claim 8 wherein the viscosity reducing solvent is propylene glycol methyl ether.

10. The composition according to claim 9 wherein the buffering agent is selected from the group consisting of sodium carbonate, sodium bicarbonate, sodium borate, monoethanolamine, and ammonium carbonate.

11. The composition according to claim 10 wherein the buffering agent is sodium borate.

12. The composition according to claim 1 further including a co-buffering agent.

13. The composition according to claim 12 wherein the co-buffering agent is an alkaline hydroxide.

14. The composition according to claim 13 wherein the alkaline hydroxide is sodium hydroxide and the ratio of sodium borate to sodium hydroxide is 1:1.

15. The composition according to claim 1 wherein the viscosity of the concentrate is less than about 300 centipoise.

16. The composition according to claim 1 wherein the dilution ratio of water to concentrate is about 3:1 to about 15:1.

17. The composition according to claim 16 wherein the viscosity of the diluted liquid soap composition is between about 500 to 10,000 centipoise.

* * * * *

UNITED STATES PATENT AND TRADEMARK OFFICE

CERTIFICATE OF CORRECTION

PATENT NO. : 6,617,293 B2
DATED : September 9, 2003
INVENTOR(S) : Chen, Yen-Lane It is certified that error appears in the above-identified patent and that said Letters Patent is hereby corrected as shown below:

Column 1,
Line 27, please delete “become” and insert in place thereof -- becomes --.
Line 53, please delete “to” following “water”.

Column 2,
Lines 44-46, please delete “concentrated liquid soap composition which readily increases in viscosity upon dilution with water, the concentrated liquid soap composition comprising”.
Line 55, please delete “tradition” and insert in place thereof -- traditional --.
Line 59, please insert -- with -- following “interfere”.

Column 3,
Line 17, please delete “degree” and insert in place thereof -- degrees --.

Column 4,
Line 62, please delete “alkanonamides” and insert in place thereof -- alkanolamides --.
Line 64, please delete “Additionaly” and insert in place thereof -- Additionally --.

Column 5,
Line 3, please delete “ca” and insert in place thereof -- can --.
Line 12, please insert -- of -- following “amounts”.
Line 33, please delete “The more preferred.”

Column 6,
Line 16, please delete “diethanloamine” and insert in place thereof -- diethanolamine --.

Column 7,
Line 27, please delete “C2and” and insert in place thereof -- C2 and --.

UNITED STATES PATENT AND TRADEMARK OFFICE

CERTIFICATE OF CORRECTION

PATENT NO. : 6,617,293 B2
DATED : September 9, 2003
INVENTOR(S) : Chen, Yen-Lane It is certified that error appears in the above-identified patent and that said Letters Patent is hereby corrected as shown below:

Column 8,
Table 3, line 13, please delete "ALAKAMIDE" and insert in place thereof
-- ALKAMIDE --.

Signed and Sealed this

Twenty-seventh Day of July, 2004

JON W. DUDAS
*Acting Director of the United States Patent and Trademark Office*